US007946144B2

(12) United States Patent
Smith et al.

(10) Patent No.: US 7,946,144 B2
(45) Date of Patent: May 24, 2011

(54) LOCK CYLINDER

(75) Inventors: Martin Smith, Burntwood (GB); Craig John Barnett, Worcester (GB)

(73) Assignee: Archibald Kenrick & Sons Limited, West Bromwich (GB)

( * ) Notice: Subject to any disclaimer, the term of this patent is extended or adjusted under 35 U.S.C. 154(b) by 0 days.

(21) Appl. No.: 11/782,482

(22) Filed: Jul. 24, 2007

(65) Prior Publication Data

US 2008/0168813 A1 Jul. 17, 2008

(30) Foreign Application Priority Data

Jan. 13, 2007 (GB) ..... 0700676.0

(51) Int. Cl.
*E05B 9/08* (2006.01)

(52) U.S. Cl. ..... 70/370; 70/371; 70/224; 70/451; 70/416

(58) Field of Classification Search ..... 70/224, 70/416, 417, 451, 466, 370, 371, DIG. 35, 70/DIG. 60; 292/348, 356, 357
See application file for complete search history.

(56) References Cited

U.S. PATENT DOCUMENTS

| | | | | |
|---|---|---|---|---|
| 3,233,440 | A * | 2/1966 | Strauss | 70/370 |
| 3,293,892 | A * | 12/1966 | Falk | 70/493 |
| 3,473,356 | A * | 10/1969 | Niilola | 70/360 |
| 3,981,168 | A * | 9/1976 | Vanelli Coralli et al. | 70/417 |
| 4,051,703 | A * | 10/1977 | Plaiss | 70/371 |
| 5,479,801 | A * | 1/1996 | Keller | 70/373 |
| 5,501,087 | A * | 3/1996 | Keller | 70/370 |
| 5,666,835 | A * | 9/1997 | Keller | 70/397 |
| 7,104,098 | B2 * | 9/2006 | Romero et al. | 70/224 |
| 7,428,836 | B2 * | 9/2008 | Yang et al. | 70/379 R |
| 2003/0074939 | A1 * | 4/2003 | Braun | 70/409 |

* cited by examiner

*Primary Examiner* — Suzanne D Barrett
(74) *Attorney, Agent, or Firm* — Pedersen and Company, PLLC; Ken J. Pedersen; Barbara S. Pedersen

(57) ABSTRACT

A lock cylinder which can be fitted into a part of a lock assembly of a door or other operable panel. There is provided a lock cylinder (114; 214; 314; 414; 514; 614; 714) adapted for fitment into the lock housing (12), the lock cylinder comprising a key-operated locking part and an actuator (50), the lock cylinder having a predetermined profile for most of its length, and a securing part (70; 72,74; 76,78; 80,82; 170,172; 270,272; 370) projecting from the predetermined profile. The securing part is adapted to lie underneath a part of the lock assembly in use, such as a face plate of an operating handle of the lock assembly, so that the securing part prevents unauthorised removal of the lock cylinder through the face plate.

5 Claims, 12 Drawing Sheets

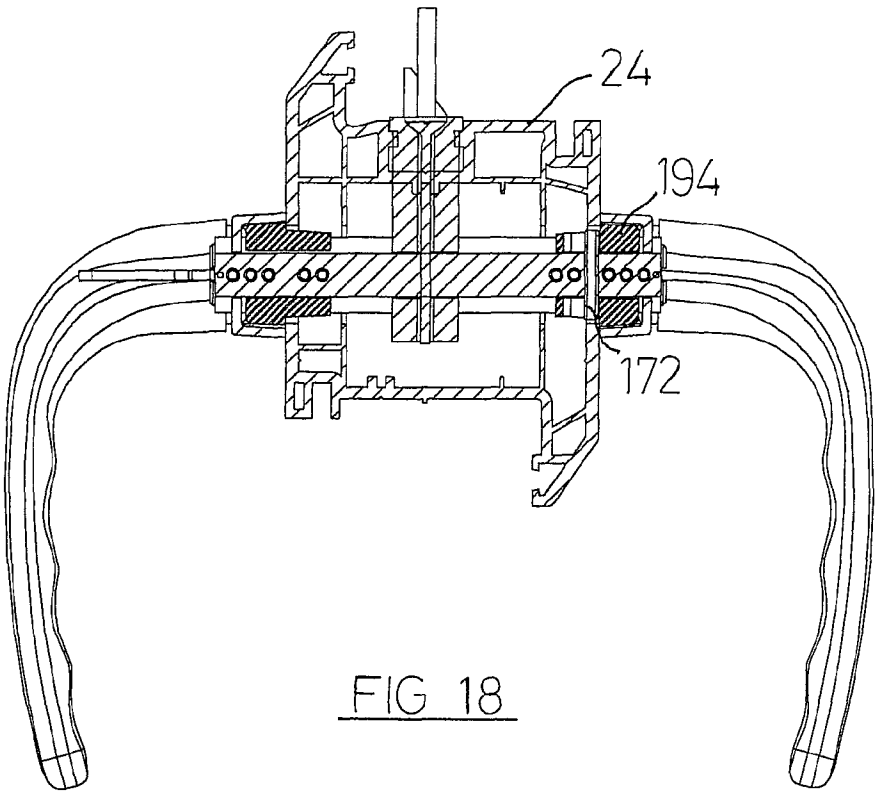
FIG 18
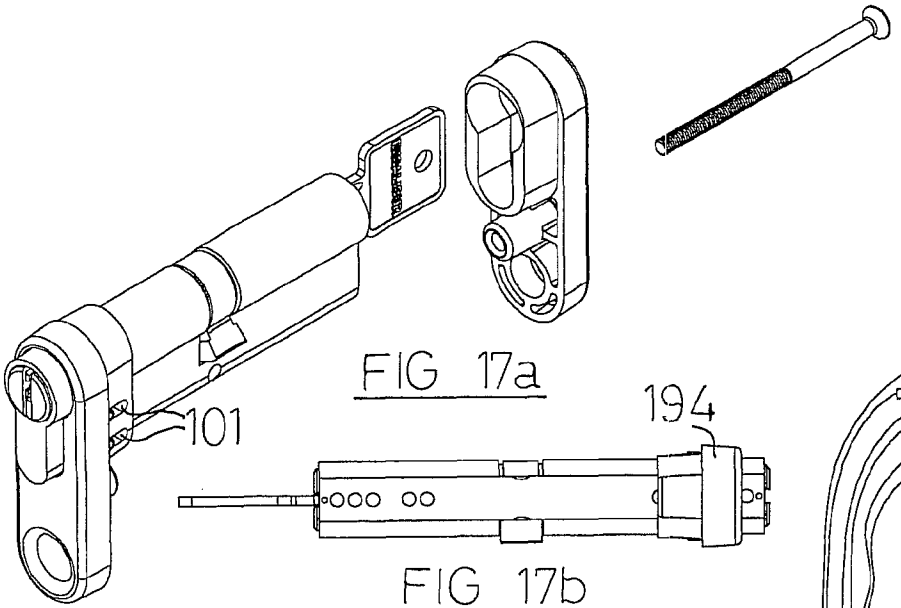
FIG 17a
FIG 17b
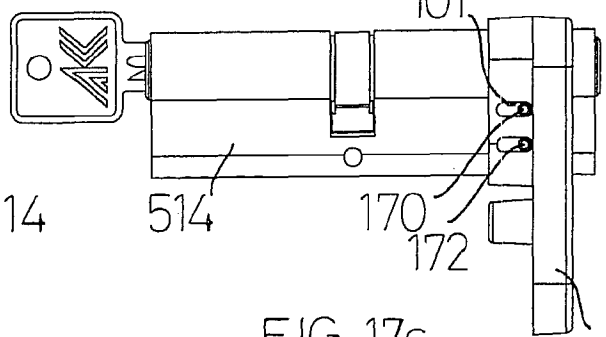
FIG 17c
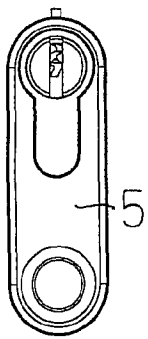
FIG 17d

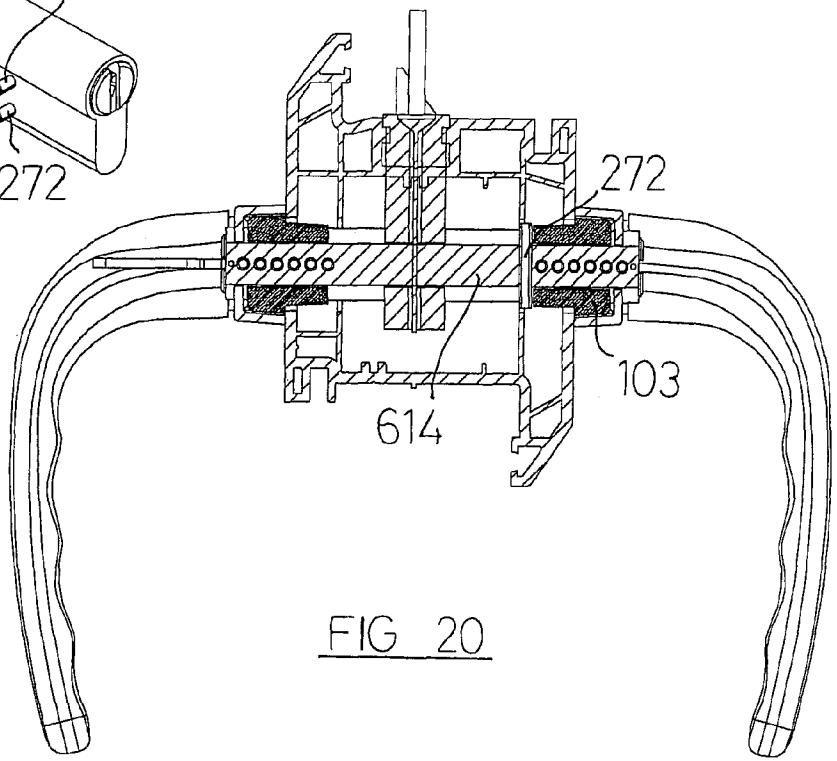
FIG 20
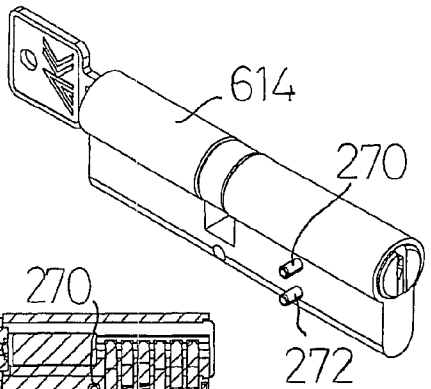
FIG 19a
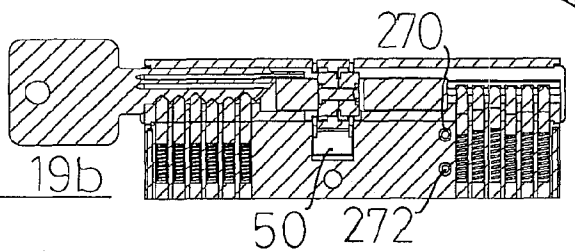
FIG 19b
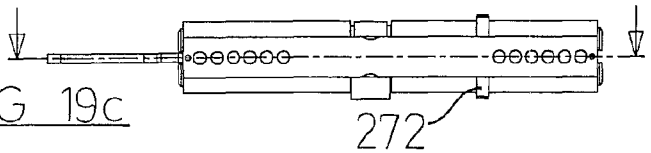
FIG 19c
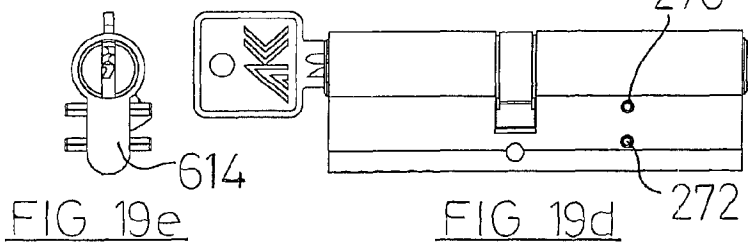
FIG 19d
FIG 19e 370
714

714
370

370

370

714

370

LOCK CYLINDER

This application claims priority of GB Patent Application 0700676.0, filed Jan. 13, 2007.

FIELD OF THE INVENTION

This invention relates to a lock cylinder, and in particular to a lock cylinder which can be fitted into a lock housing of a door.

BACKGROUND OF THE INVENTION

Many items of security hardware are available for fitment to a home or other building in order to make the building more secure. Many different manufacturers make such security hardware. It is not unusual for a manufacturer to make only some of the security hardware, and for example a particular manufacturer may make the key-operated lock cylinder which is supplied to other manufacturers who make the lock housings and other componentry to which the lock cylinder is fitted.

The lock cylinder has a longitudinal axis. For the avoidance of doubt, in the following description and claims the term "length" of the lock cylinder is used to refer to the dimension of the lock cylinder in the direction of the longitudinal axis, and the term "profile" of the lock cylinder is used to refer to the cross-sectional outline of the lock cylinder in a plane which is perpendicular to the longitudinal axis.

In order to facilitate the use of componentry by others, it is known to make some of the componentry of a standard size and shape. One such standardised item are lock cylinders, which in Europe are substantially all made to the "Euro-profile", i.e. a profile common to most if not all lock cylinders so that a lock housing manufacturer can make its lock housings to accommodate the standard profile in the knowledge that he can then purchase the standardised lock cylinder from one of several manufacturers.

Typically, the lock cylinder will contain a key-operated locking part and an actuator, it being arranged that the actuator may be moved only upon insertion and rotation of the correct key into the locking part, the key being inserted in a direction parallel to, and perhaps coincident with, the longitudinal axis of the lock cylinder. The lock housing will contain componentry which can be moved by the actuator to effect unlocking and/or unlatching of the door.

Many doors to which a lock housing is fitted require key-controlled access from both sides of the door, in which case the lock cylinder has two opposed locking parts with the actuator therebetween. The two parts are physically connected by a bridge, and each of the two opposed locking parts can be actuated by insertion and rotation of the correct key. In this way, insertion and rotation of the correct key into the lock cylinder from either side of the door causes rotation of the actuator and unlocking and/or unlatching of the door.

Whilst the use of a standard lock profile has significant advantages for the security hardware industry, it also has a significant disadvantage. This is that an intending intruder can acquaint him or herself with the method of fitment of the lock to the housing, in the knowledge that almost any lock he or she will seek to overcome will have the same method of fitment. Accordingly, the intending intruder does not need to acquaint him or herself with many different methods of fitment, and therefore many different methods of gaining unauthorised access.

This disadvantage has become increasingly well-known in relation to Euro-profile lock cylinders, and in order to better explain this disadvantage, reference is made to FIG. 1 and FIGS. 2*a-e* of the accompanying drawings, which show a prior art lock cylinder and its typical fitment into a door.

As shown in FIGS. 1 and 2*a-e*, the typical locking componentry for a door 10 (only a small part of which is shown) comprises a lock housing 12, a lock cylinder 14, an inner face plate 16 carrying an inner handle 18, and an outer face plate 20 carrying an outer handle 22. (References to "inner" and "outer" herein relate respectively to the inside and outside of the door 10 in the normal orientation of use).

The door 10 in this drawing is of extruded plastics, comprising a hollow door profile 24 of particular dimensions (the door profile 24 having certain standard dimensions and other non-standard dimensions which are peculiar to the particular manufacturer).

The lock edge 26 of the door profile 24 is recessed or rebated (not shown) in order to accommodate the lock housing 12, the lock housing 12 comprising a locking bolt 30 and a latch 32, both of which in use can project from the locking edge 26 and into a keeper (not shown) fitted into the surrounding door frame (also not shown).

Additional holes are made in the door profile 24 to accommodate other parts of the locking componentry, specifically the hole 34 is made to accommodate the lock cylinder 14, the holes 36 to accommodate the drive bar 40 which interconnects the handles 18 and 22 (the lock housing 12 in this embodiment having two alternative locations 42 for the drive bar 40), and the holes 44 to accommodate the bolts 46 which interconnect the face plates 16 and 20. It will be understood that the holes 34, 36 and 44 pass right through the door profile 24.

In typical fashion, the drive bar 40 actuates the latch 32 and the locking bolt 30. The lock housing 12 will contain componentry to allow rotary movement (typically downwards rotary movement) of the handles 18, 22 to draw the latch 32 and bolt into the lock housing (and out of engagement with their respective keepers), and another rotary movement (typically an upwards rotary movement) to drive the locking bolt 30 into its keeper. The lock cylinder 14 is typically connected to componentry which can prevent rotation of the drive bar 40.

The lock housing has an opening 52 therethrough which is of substantially identical shape to the profile of the lock cylinder 14, and is sized to accommodate the lock cylinder 14, so that when the lock housing 12 is fitted into the door profile 24 the lock cylinder may be slid through the hole 34 and into the opening 52 of the lock housing.

As is shown in FIG. 2*c*, the lock cylinder 14 is designed for key operation from both sides of the door, and therefore contains an inner part 54 and an outer part 56. Each of the parts 54 and 56 contains a number of (in this embodiment six) cooperating pins and tumblers, arranged so that only upon insertion of the correct key 60 can the key be rotated and drive the actuator 50 to rotate.

The two parts 54 and 56 of the lock cylinder 14 are interconnected by a bridge 62 which has a threaded aperture 64 formed therethrough. The threaded aperture 64 is adapted to receive a bolt 68 which is inserted through the hole 66 and by which the lock cylinder 14 can be secured to the lock housing 12.

Clearly, it is a useful safety feature that the bolt 68 can only be removed from the locking edge 26 of the door, to which access can only be gained whilst the door is open. Accordingly, when the door is closed and locked the intending intruder cannot remove the lock cylinder 14 by simply reversing the steps of fitment.

Instead, however, it has become recognised that the bridge 62 is the weakest part of the lock cylinder 14, and an intending intruder can seek to disable the lock by breaking the lock cylinder 14 at the bridge 62.

Specifically, the thickness of the bridge 62 is limited by the dimensions of the Euro-profile cylinder 14, and it is not possible to increase the thickness and therefore the strength of the bridge. Also, the necessity to provide a threaded hole 64 in the bridge 62 with which the bolt can engage further weakens this area of the lock cylinder 14.

Accordingly, an intending intruder can seek to gain access to a locked building by applying a sideways force onto the outer end of the lock cylinder 14, the sideways force being sufficient to break the bridge 62 adjacent to the bolt 68. Once the bridge has been broken the two parts 54,56 of the lock cylinder 14 are no longer secured by the bolt 68, and each part can be slid out of the lock housing 12. Once the outer part 56 of the lock cylinder 14 has been removed, the intruder can insert a tool into the hole 34, 52 and manipulate the componentry of the lock housing 12 in order to unlock and/or unlatch the door 10.

Manufacturers have sought to prevent such a method of attack upon a locked door by reducing the sideways movement available to the lock cylinder 14, and so reducing the sideways force which can be applied to the bridge. This is achieved by adding packing around the lock cylinder 14 and removing some or all of the free space which lies between the lock cylinder 14 and the hole 34 in the door.

However, the above-stated method of attack upon the bridge is not the only method of attack, and it is also known to provide a tensile force upon the outer end 56 of the lock cylinder 14, which force is transmitted directly (by way of the material of the lock cylinder itself to the bridge 62. Specialist tools such as slide hammers and the like can impart sufficient tensile forces to break the bridge and pull out the outer part 56 of the lock cylinder 14. Clearly, since no attempt is made to move the lock cylinder sideways, the above-stated defence is of no real benefit against this second method of attack.

SUMMARY OF THE INVENTION

The inventor has therefore realised that another method and apparatus is required to seek to defend against the second method of attack.

According to the present invention, therefore, there is provided a lock cylinder having a predetermined profile for most of its length, but including a projection to that profile at a chosen position.

The predetermined profile will typically be the Euro-profile, and the use of such a profile for most of the length of the cylinder allows the invented lock cylinder to fit to standardised lock housings and other lock componentry. However, the provision of a projection to the profile at a chosen position enables the lock profile to be retained by a part of the lock componentry in the event that the bridge is broken. Accordingly, unlike the prior defences which all sought to prevent the bridge being broken, the present invention seeks to prevent the subsequent removal of parts of the lock cylinder even if the bridge is broken. If the intending intruder cannot remove parts of the lock cylinder after breaking the bridge then the likelihood of access being gained to the lock housing to unlock and/or unlatch the door is much reduced or prevented.

Preferably, the projection is at least one securing pin. Preferably also the securing pin passes through a part of the lock cylinder adjacent to the locking componentry of the cylinder.

The chosen position is such that the projecting securing pin(s) will lie underneath the face plate at the outer side of the door in use, so that it is necessary for the intending intruder to force the securing pin(s) through the face plate to remove a part of the locking cylinder.

Removal of the part of the locking cylinder can be made more difficult by the provision of an additional security element and/or an additional security plate, both of which are adapted to lie underneath the face plate and increase the resistance to the securing pin(s) being forced therethrough.

The securing pins can pass through a part of the lock cylinder made available by the absence of a part of the locking componentry, or by the re-positioning of the locking componentry. Alternatively, the securing pin(s) can project beyond the profile without encumbrance to the locking componentry of the lock cylinder.

BRIEF DESCRIPTION OF THE PREFERRED EMBODIMENTS

The invention will now be described in more detail, by way of example, with reference to the accompanying drawings, in which:

FIG. 1 shows an exploded view of a prior art arrangement comprising a lock housing and lock cylinder for a door;

FIGS. 2*a-e* show various views of a prior art lock cylinder;

FIGS. 3*a-d* show various views of a first embodiment of lock cylinder according to the invention;

FIG. 4 shows the sectional view through a door fitted with a lock cylinder of FIGS. 3*a-d;*

FIGS. 5*a-d* show various views of a second embodiment of lock cylinder according to the invention;

FIG. 6 shows the sectional view through a door fitted with a lock cylinder of FIGS. 5*a-d;*

FIGS. 7*a-d* show various views of a third embodiment of lock cylinder according to the invention;

FIG. 8 shows the sectional view through a door fitted with a lock cylinder of FIGS. 7*a-d;*

FIGS. 9*a-e* show various views of a fourth embodiment of lock cylinder according to the invention;

FIG. 10 shows the sectional view through a door fitted with a lock cylinder of FIGS. 9*a-e;*

FIGS. 11*a-c* show various views of an additional security element;

FIG. 12 shows a view similar to that of FIG. 6, with the additional security element;

FIGS. 13*a-c* show various views of the additional security plate;

FIGS. 17*a-d* show various views of a firth embodiment of lock cylinder according to the invention;

FIG. 18 shows the sectional view through a door fitted with a lock cylinder of FIGS. 17*a-d;*

FIGS. 19*a-e* show various views of a sixth embodiment of lock cylinder according to the invention;

FIG. 20 shows the sectional view through a door fitted with a lock cylinder of FIGS. 19*a-e;*

Figures 21A, 21B, 21C, 21D, 21E, 22:
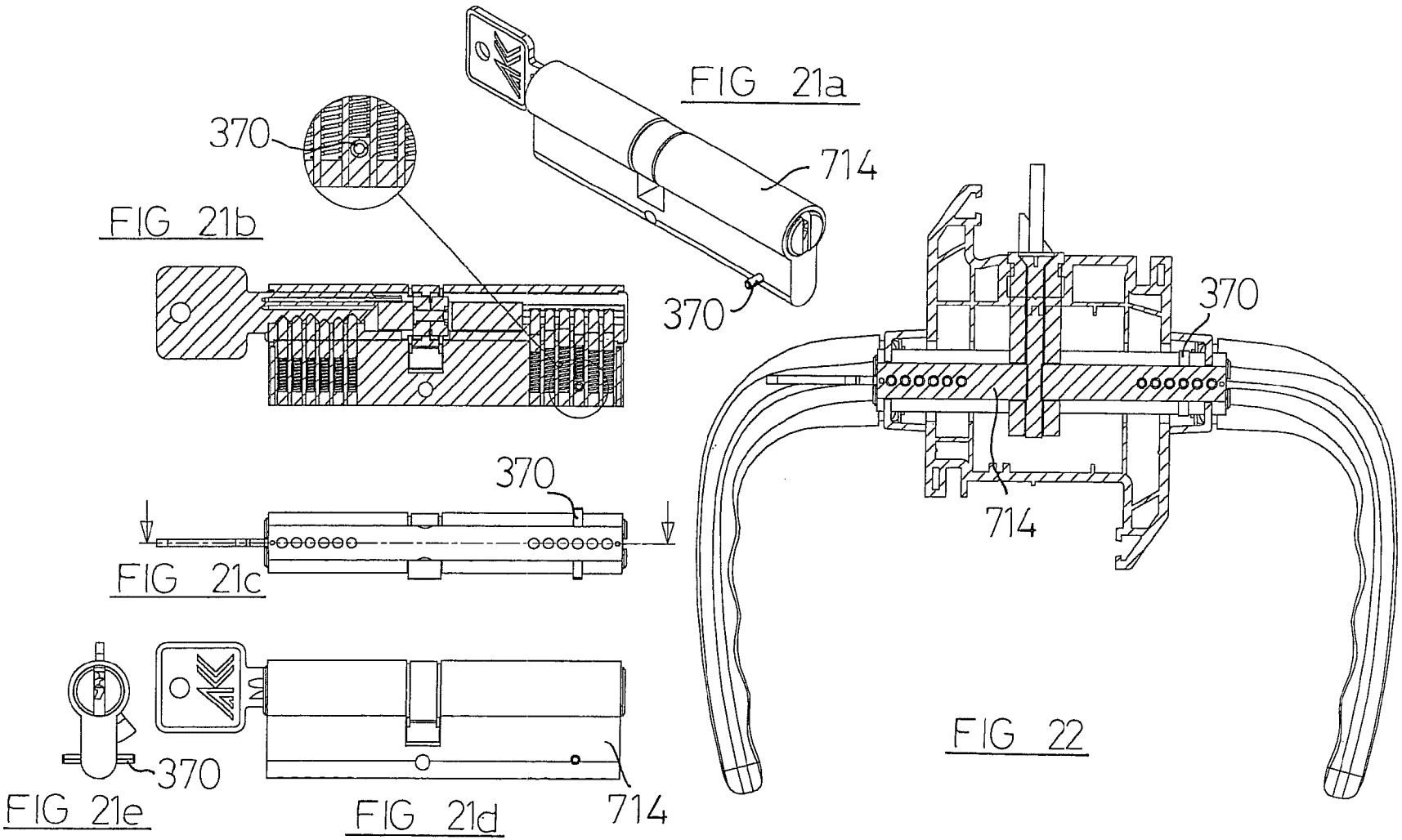

FIGS. 21 *a-e* show various views of a seventh embodiment of lock cylinder according to the invention; and FIG. 22 shows the sectional view through a door fitted with a lock cylinder of FIGS. 21*a-e;*

DETAILED DESCRIPTION

Figure 1:
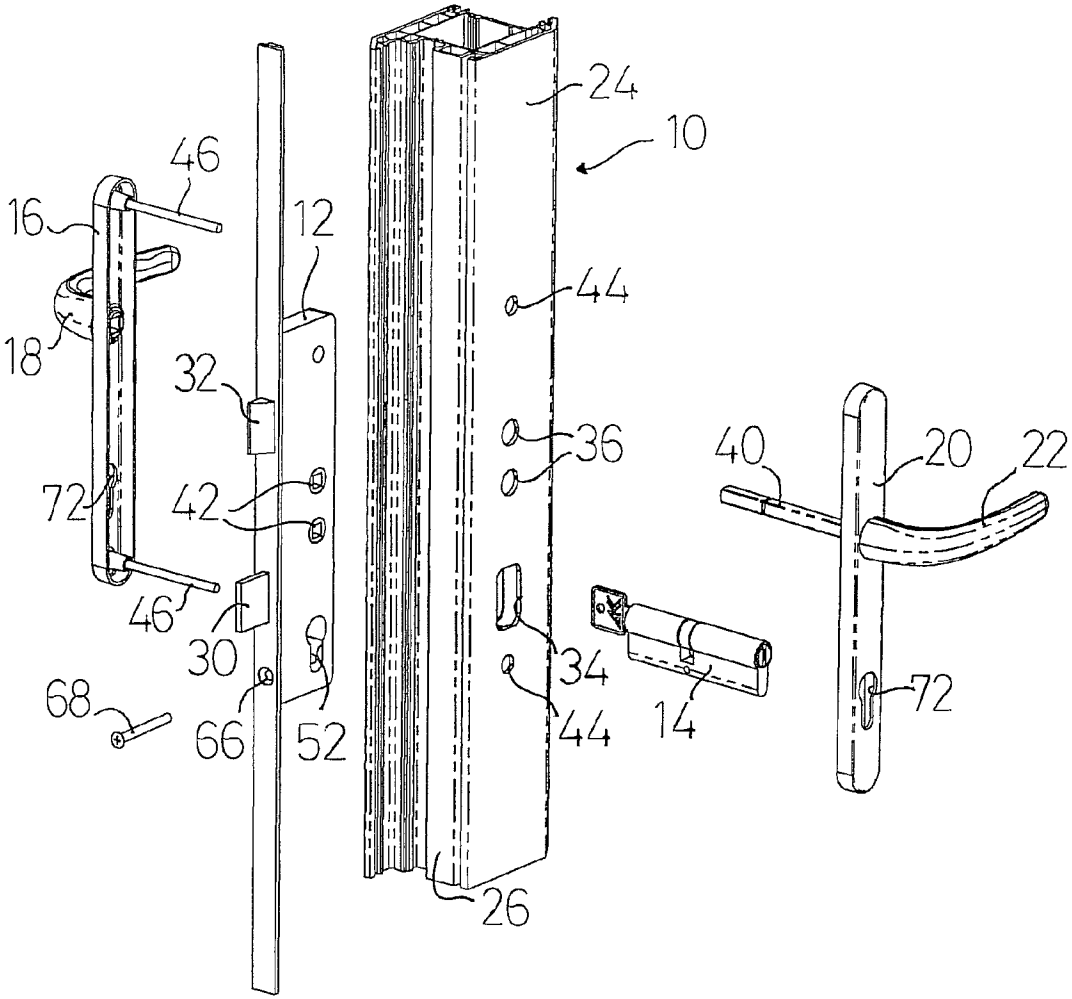
FIG 1 PRIOR ART
Figure 2C:
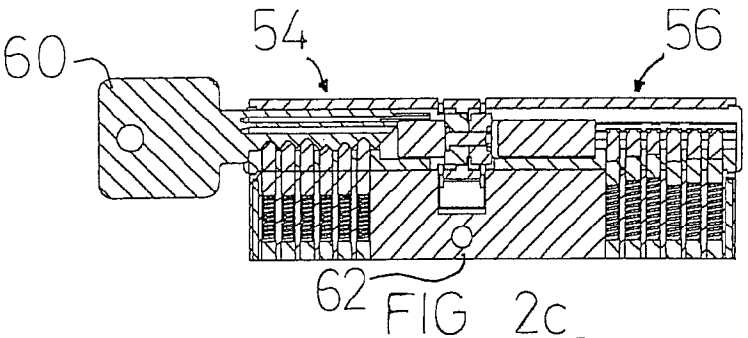
FIG 2c PRIOR ART
Figure 2D:
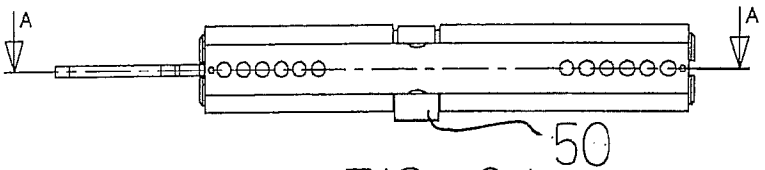
FIG 2d PRIOR ART
Figure 2E:
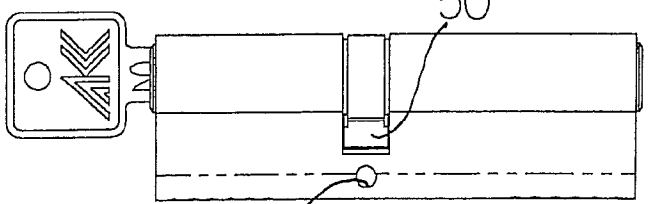
FIG 2e PRIOR ART
Figure 2A:
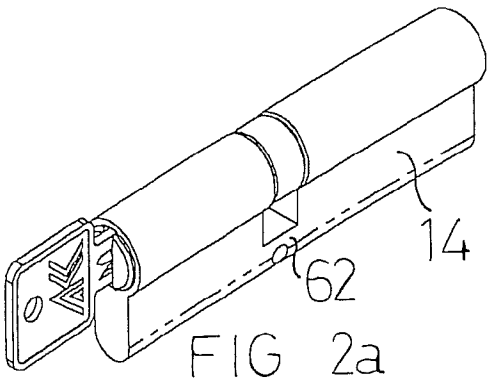
FIG 2a PRIOR ART
Figure 2B:
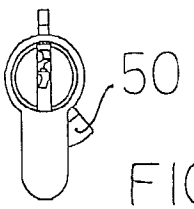
FIG 2b PRIOR ART

A detailed explanation of the prior art components and arrangements of FIGS. 1-2*e* is provided above, and so will not be repeated. The present invention relates to a replacement for the lock cylinder 14, and all of the other componentry can be retained (and is therefore given the same reference numerals in the following description). It will be understood that the form of the door profile 24 is not relevant to the present invention, and it will also be understood that the invention can be used with doors of other materials than plastics, and indeed for other applications than doors, where a standard profile lock cylinder such as a Euro-profile lock cylinder is used.

Figure 4:
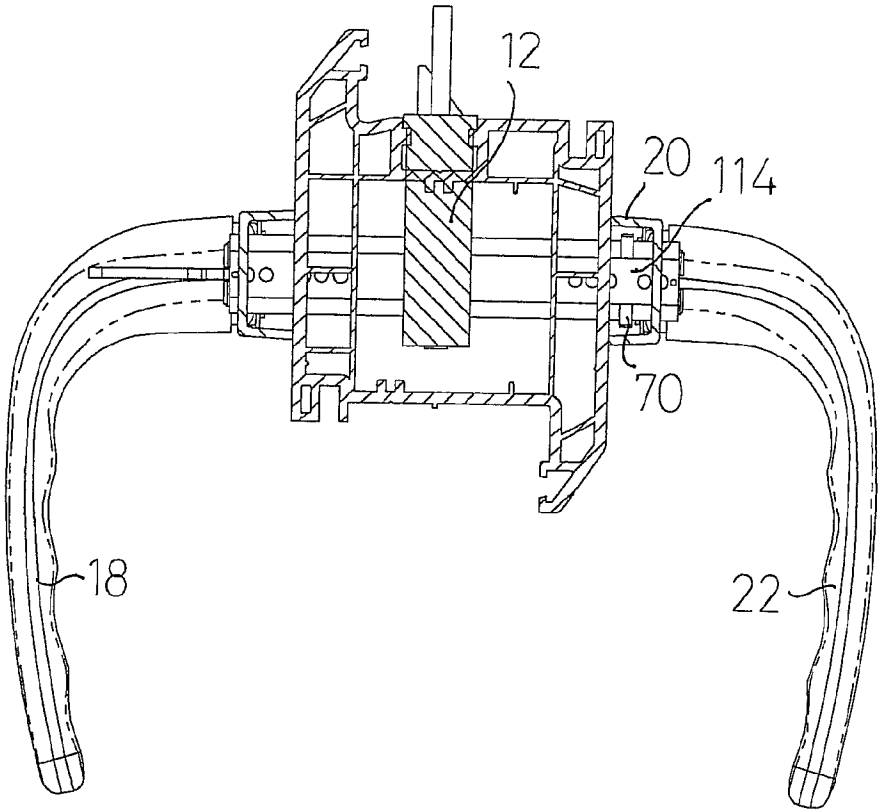
Figure 3A:
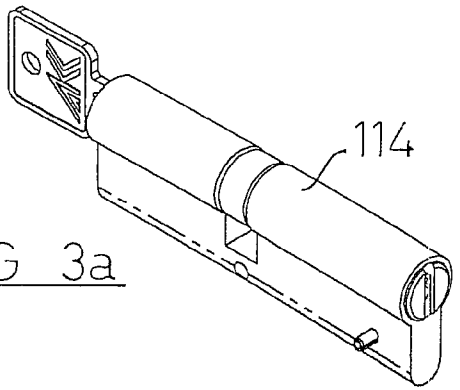
Figure 3B:
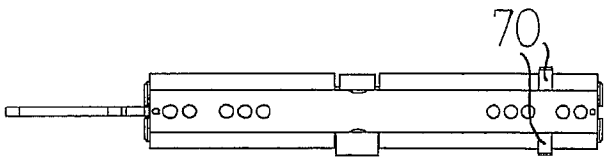
Figure 3C:
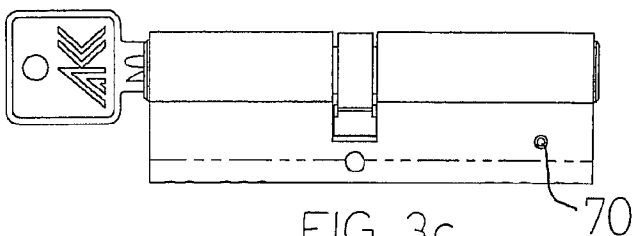
Figure 3D:
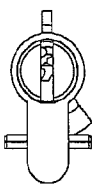
Figure 6:
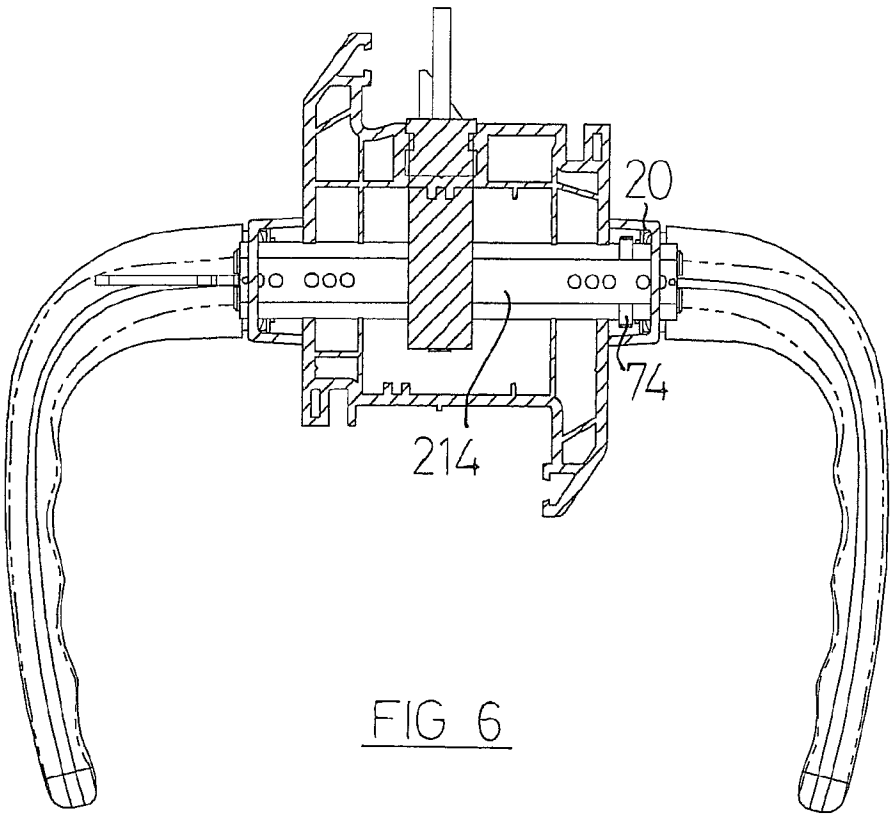
Figure 5A:
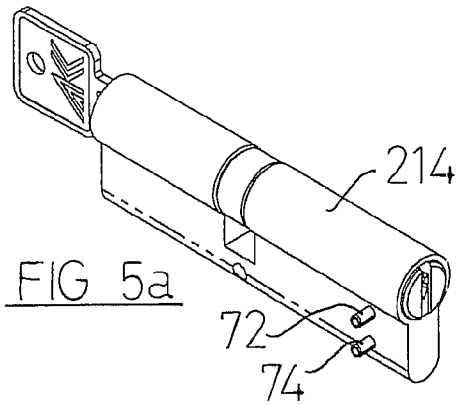
Figure 5B:
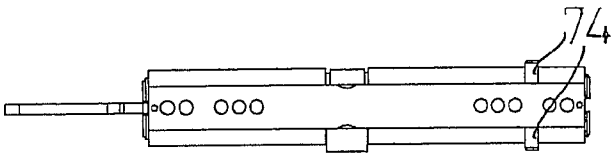
Figure 5C:
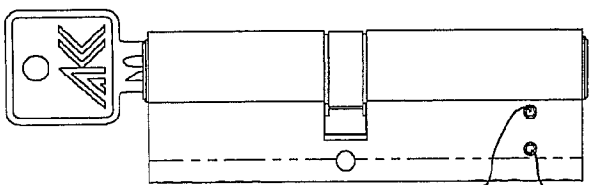
Figure 5D:
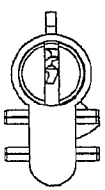
Figure 8:
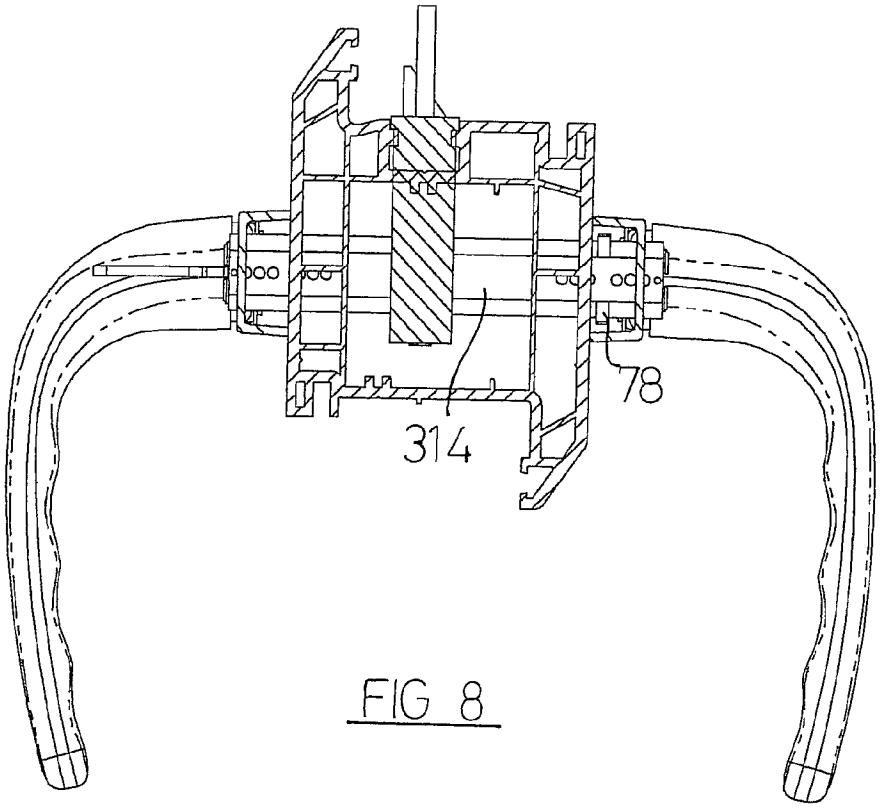
Figure 7A:
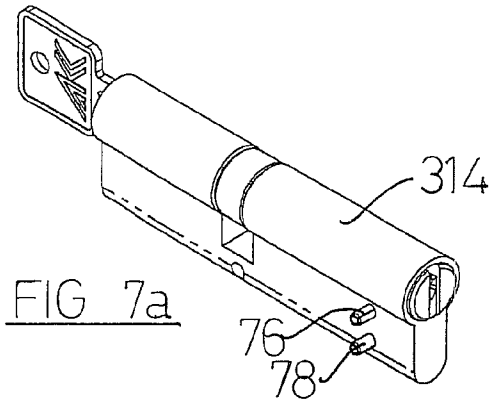
Figure 7B:
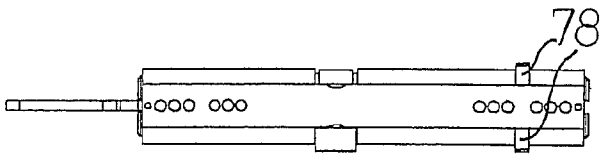
Figure 7C:
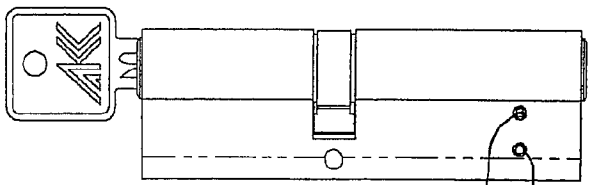
Figure 7D:
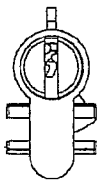
Figures 9A, 9B, 9C, 9D, 9E, 10:
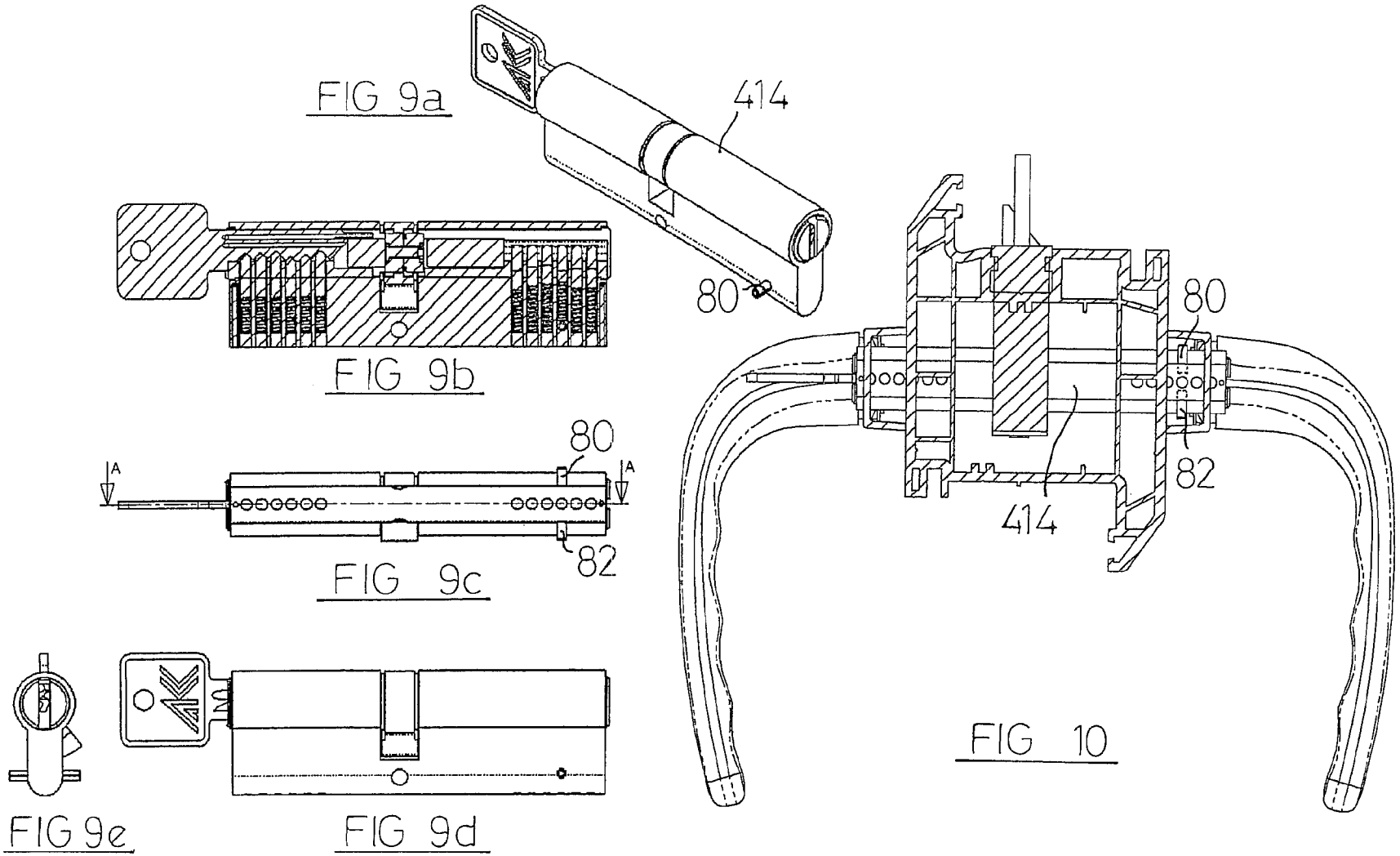

The first embodiment of the present invention is shown in FIGS. 3*a*-3*d* and 4. It will be seen that one of the six sets of cooperating pins and tumblers which make up the locking componentry of the lock cylinder has been removed, and replaced by a securing pin 70 which passes through the body of the lock cylinder 114 and projects from the profile thereof. As seen in FIG. 4, the location of the securing pin 70 is chosen to lie beneath the outer face plate 20. As shown in FIG. 1 the face plates 16 and 20 have an opening 72 therethrough of substantially identical shape to the Euro-profile of the cylinder, and which openings can accommodate the lock cylinder 14, 114. However, the securing pin 70 cannot pass through the opening 72 in the face plate 20 and the presence of the securing pin 70 therefore prevents removal of the outer part 56 of the lock cylinder 14 even if the bridge 62 is broken.

It will also be understood from FIG. 1 that the face plate 20 is secured by way of bolts 46 (typically M5 or M6 bolts) which pass through the door profile 24 and secure the face plates 16 and 20 together. Specifically, the bolts 46 locate into blind threaded bores (not shown) in the rear surface of the face plate 20. Without access to the inner end of the bolts 46 located on the inside of the door, the face plate 20 cannot be removed without destroying either the face plate or a part of the door, and it is extremely unlikely that the intending intruder will be prepared to, or able to, destroy either item, or will be armed with the tools necessary for that.

In the second embodiment of FIGS. 5*a*-*d* and 6, the lock cylinder 214 has two securing pins 72, 74, but is otherwise identical to the first embodiment described above. The provision of two securing pins increases the resistance to attempts to force the outer part 56 of the lock cylinder 214 through the face plate 20.

It will be understood that in the first and second embodiments described above, the locking componentry of the lock cylinder 114, 214 is modified, i.e. the number of cooperating pins and tumblers within the lock cylinder is reduced in order to accommodate the securing pin within a lock cylinder of identical dimensions. The use of five cooperating pins and tumblers does, however, reduce slightly the level of security of the lock cylinder, and it may be preferred to retain six cooperating pins and tumblers.

In the embodiment of FIGS. 7*a*-*d* and 8, therefore, a lock cylinder 314 is provided, having identical outer dimensions to that of the second embodiments, but employing six cooperating pins and tumblers. The cooperating pins and tumblers are made of reduced size in order to fit within the available volume of the lock cylinder 314, and yet accommodate the securing pins 76 and 78.

The fourth embodiment of FIGS. 9*a*-*e* and 10 uses two separate but coaxial securing pins 80 and 82. Since the pins 80, 82 do not pass through the body of the lock cylinder they do not foul the locking componentry, and the pins and tumblers of the lock cylinder 414 are substantially identical to those of the prior art lock cylinder 14. Whilst this fourth embodiment provides the projection required to foul the face plate 20 upon intended removal of the outer part 56 of a broken lock cylinder, it is less preferred than the earlier embodiments as a securing pin which passes through the body of the lock cylinder will typically be able to withstand greater shear loads.

It will be understood that in the embodiments of FIGS. 4, 6, 8 and 10 it is the face plate 20 which prevents removal of the outer part 56 of the broken lock cylinder by virtue of the securing pin(s) fouling the face plate 20. It is, however, known that some manufacturers provide relative thin and weak face plates, and in particular face plates through which an intending intruder may be able to force the securing pins. FIGS. 11-14 show additional security components designed to reduce the likelihood of that.

Figures 11A, 11B, 11C, 12:
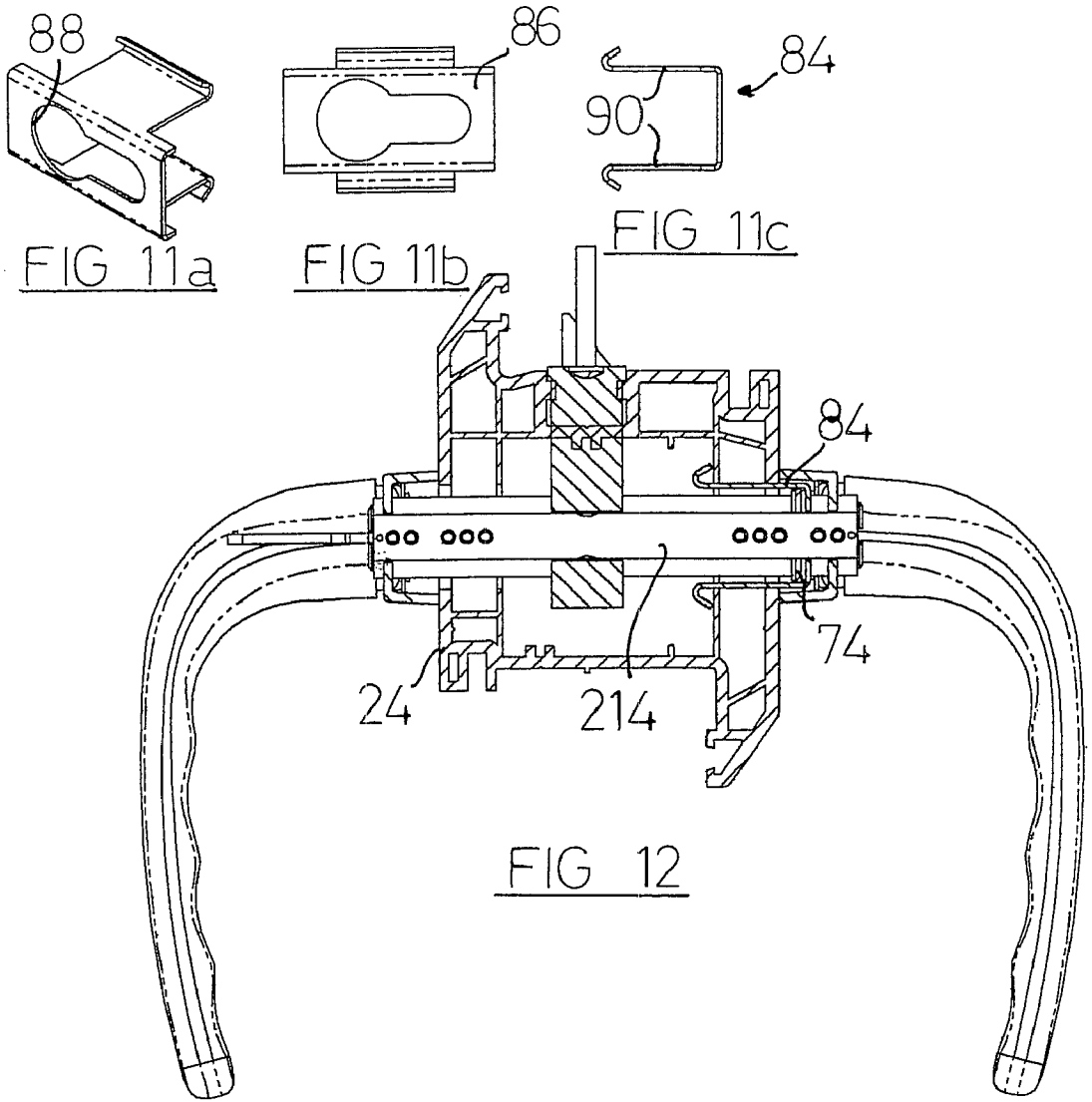

FIGS. 11*a*-*c* show an additional security element 84 which is made of pressed steel and has a plate part 86 with a hole 88 of Euro-profile therethrough to accept the lock cylinder 214 (in this embodiment, although the clip could equally be used with the other embodiments of lock cylinder, as desired). As shown in FIG. 12, in use the additional security element 84 is installed prior to fitment of the face plate 20 (the element 84 can be installed after the lock cylinder 214, or alternatively can be installed before the lock cylinder 214 requiring the lock cylinder to be fitted from the inside of the door). The element 86 has a pair of resilient arms 90 which clip underneath an internal part of the door profile 24. The lock cylinder securing pins 72, 74 fit underneath the plate part 86, and if the bridge 62 is broken the intending intruder has to force the securing pins 72, 74 through the plate part 86 as well as through the face plate 20.

Figures 13A, 13B, 13C, 14:
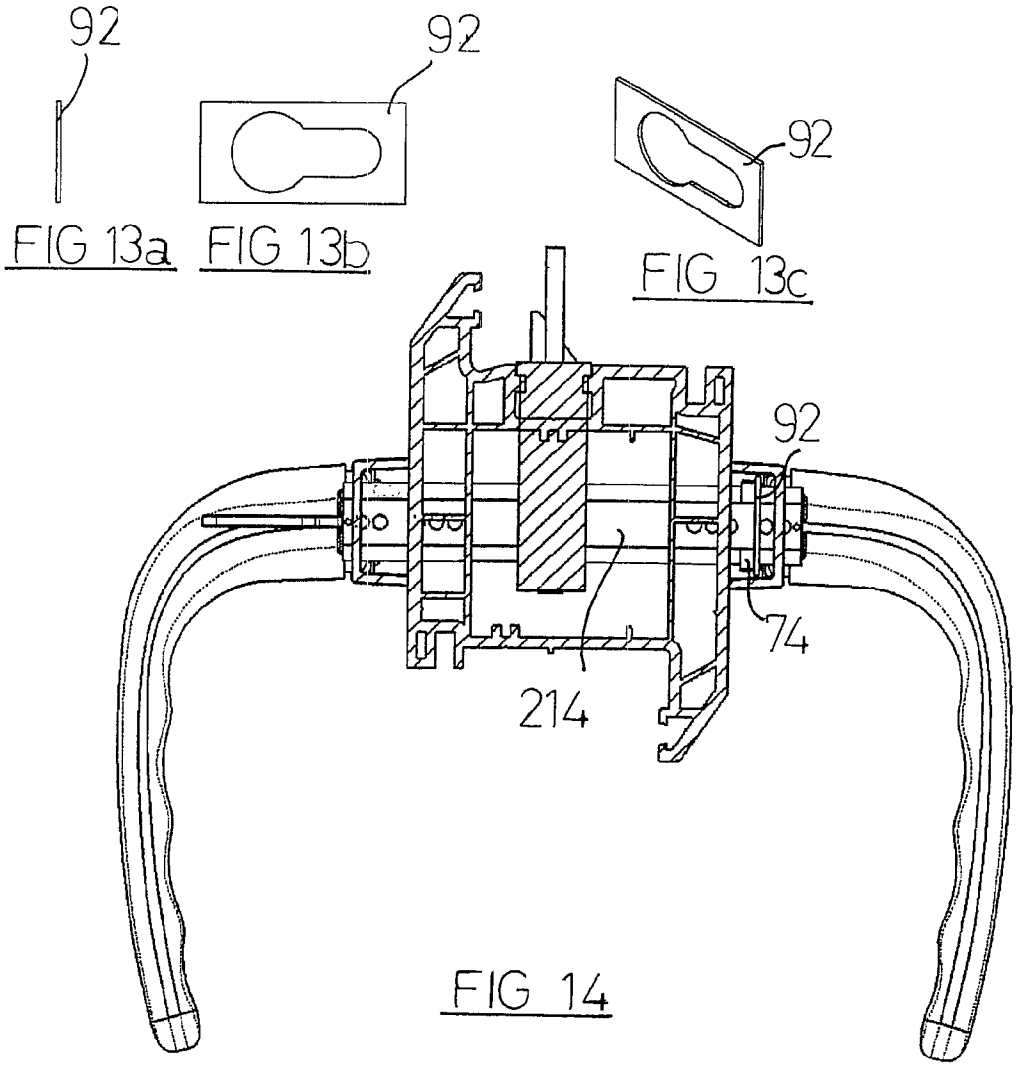
FIG. 14 shows a view similar to that of FIG. 6, with an additional security plate.

The additional security plate 92 of FIGS. 13*a*-*c* is also of pressed steel, and is for a similar purpose to the additional security element 84, but is of simpler design. The additional security plate 92 merely sits within the face plate 20 (see FIG. 14) and acts to spread the load of any attempt to force the pins 72, 74 through the face plate 20 across a larger area of the face plate, so reducing the likelihood that such attempts will be successful.

Figure 16:
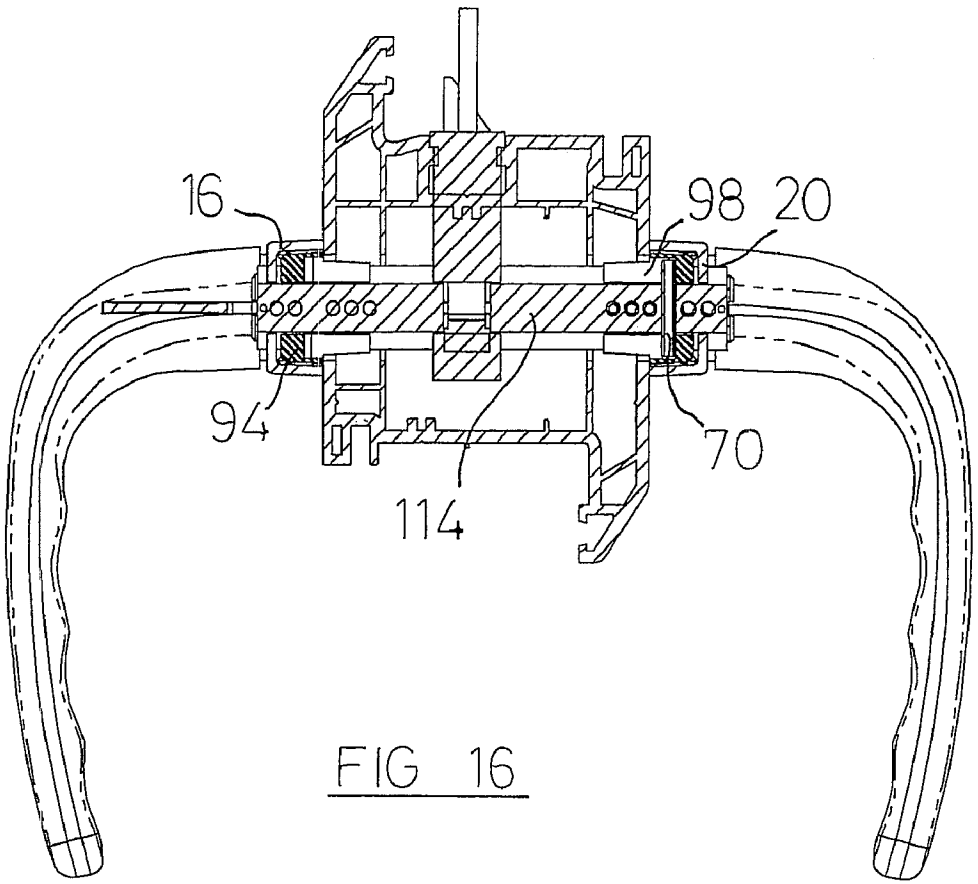
FIG. 16 shows a view similar to that of FIG. 6, with the additional security plugs.
Figure 15:
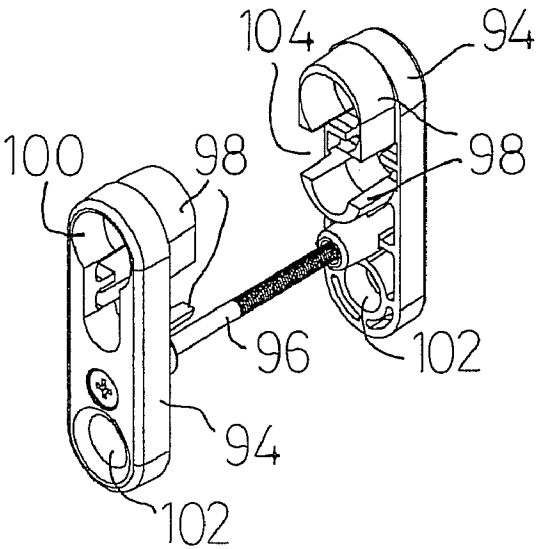
FIG. 15 shows a pair of additional security plugs and their connecting bolt.

FIGS. 15 and 16 show a pair of additional security plugs 94, one of which is fitted to the outside of the door, the other of which is fitted to the inside of the door. As seen in FIG. 16, the additional security plugs 94 are adapted to fit underneath the respective face plates 16,20, and are secured together by a bolt 96. The bolt 96 passes underneath the bottom edge (as viewed) of the lock housing 12, or alternatively the lock housing 12 may contain a notch in its bottom edge or a hole for the bolt 96.

The additional security plugs 94 have formations 98 which are sized to fit within the hole 34, and substantially fill the hole 34 so as to reduce or eliminate sideways movement of the lock cylinder within the hole 34. The formations 98 surround an opening 100 through which the lock cylinder can be fitted. In this embodiment the additional security plugs 94 also have aligned holes 102 which accommodate the lower of the bolts 46 which interconnect the face plates 16 and 20.

In the embodiment of FIG. 16 the additional security plugs 94 are used with a lock cylinder 114 of FIGS. 3 and 4, though it will be understood that they could alternatively be used with any of the lock cylinders previously described.

The formations 98 are not continuous, but instead include a gap 104 which can accommodate the securing pin 70 (though it will be understood that in other embodiments two gaps, or one enlarged gap, could be provided to accommodate two securing pins such as 72 and 74; or 78 and 80, if desired).

It will be seen from FIG. 16 that the securing pin 70 is located beneath the body of the external additional security plug 94, and attempts to forcibly remove the lock cylinder 114 from the door will require the intending intruder first to break the lock cylinder 114 as previously described (which breakage is itself made more difficult because the additional security plug 94 substantially fills the hole 34), and then either to force the securing pin 70 through the body of the additional security plug 94 and then through the face plate 20, or else to forcibly remove the additional security plug and the face plate from the door. It can be arranged that the additional security plug 94 is sufficiently robust to withstand even determined attempts to force the security pin 70 therethrough, and the bolt 96 which connects the two additional security plugs 94 will help to prevent the forced removal of the security plug.

In the embodiment of FIGS. 17*a-d* the security plug 194 is secured to the lock cylinder 514 as part of the assembly procedure, so that the lock cylinder 514 and security plug 194 are supplied as a single component for fitment to the profile 24, which will make fitment easier for the installer.

The securing pins 170, 172 are fitted through two slots 101 in the skirt of the security plug 194. This allows the security plug 194 to move relative to the lock cylinder by a distance corresponding to the length of the slots 101. In this embodiment the length of the slots 101 is 5 mm, and this length is chosen because lock cylinders are made in discrete lengths which differ in steps of 5 mm. Permitting 5 mm of movement between the security plug 194 and the lock cylinder 514 will ensure that the security plug can be correctly located within the hole 34 in the profile 24, regardless of the thickness of the profile 24 and therefore regardless of the length of lock cylinder chosen to fit that profile.

It will be seen from FIG. 18 that in this embodiment the securing pins 170, 172 lie within the volume of the profile 24, i.e. the pins 170, 172 are hidden below the surface of the profile (this feature can be shared by the other embodiment if desired).

In the embodiment of FIGS. 19 and 20, the lock cylinder 614 is modified less than are the lock cylinders of the other embodiments. Specifically, in this embodiment the securing pins 270, 272 are fitted between the pins and tumblers and the actuator 50. This avoids any requirement to reduce the number of pins and tumblers, or to modify a pin and tumbler. In addition, the installer can use an existing packer 103 to fill some or all of the free space between the lock cylinder 614 and the hole 34 in the profile 24. As such, this embodiment is particularly suitable for retro-fitment to a panel which already incorporates a packer 103.

The embodiment of FIGS. 21 and 22 uses a single securing pin 370, and the lock cylinder 714 is modified over a standard lock cylinder by having a longer retaining plug in one of the pin and tumbler chambers. The retaining plug is fitted into the bottom of the pin and tumbler chamber to retain a spring in engagement with the pin and tumbler. The use of a longer retaining plug results in a reduced-length chamber, and the pin 370 passes through the elongated retaining plug.

The use of the present invention does not preclude the use of other methods to seek to prevent breakage of the bridge, for example other methods of the packing of the free space between the lock cylinder and the hole 34, for example.

Clearly, the securing pins 70, 72, 74, 76, 78, 80, 82, 170, 172, 270, 272 and 370 are made sufficiently rigid to withstand the considerable shearing forces which may be applied by an intending intruder armed with a slide hammer or the like. The securing pins are preferably solid, and of hardened steel or the like. The securing pin(s) may for example be hardened steel roll or spiral pins, for example. In all of the embodiments shown the securing pin(s) project from both sides of the lock cylinder, and whilst that is preferred the use of one or more securing pins projecting from only one side of the lock cylinder is not thereby excluded.

The invention claimed is:

1. A lock cylinder adapted for fitment into a lock housing, the lock cylinder having a longitudinal axis and comprising two key-operated locking parts and an actuator, the actuator being located between the key-operated locking parts, the lock cylinder having a predetermined profile for most of its length, wherein a securing part projects from the predetermined profile, the securing part having a longitudinal axis, the longitudinal axis of the securing part being substantially perpendicular to the longitudinal axis of the lock cylinder, in which the securing part projects from one of the key-operated locking parts, and in which the other of the key-operated locking parts has no securing part.

2. A lock cylinder according to claim 1 in which the securing part comprises at least one securing pin.

3. A lock cylinder according to claim 2 in which the securing pin(s) pass(es) through said one of the key-operated locking parts of the lock cylinder.

4. A lock cylinder according to claim 3 in which said one of the key-operated locking parts of the lock cylinder has a number of cooperating pins and tumblers, and the securing pin(s) pass(es) through the lock cylinder adjacent to a pin and tumbler.

5. A locking assembly for an openable panel comprising a lock housing and a lock cylinder adapted for fitment into the lock housing, the lock cylinder having a longitudinal axis and comprising a key-operated locking part and an actuator, the lock cylinder having a predetermined profile for most of its length, and a securing part projecting from the predetermined profile, the lock housing in use being mounted upon the openable panel and the lock cylinder in use being located within the lock housing whereby the openable panel is made lockable, the lock housing cooperating with at least one operating handle mounted upon the openable panel, the operating handle having a mounting element by which the operating handle is secured to the openable panel, the securing part being located between the lock housing and the mounting element, the mounting element having an opening to accommodate the lock cylinder, the securing part projecting beyond the opening in a direction perpendicular to the longitudinal axis.

* * * * *